United States Patent [19]

Johnson, III

[11] Patent Number: 4,500,108

[45] Date of Patent: Feb. 19, 1985

[54] CONVERTIBLE SKI DEVICE

[76] Inventor: Luvern C. Johnson, III, P.O. Box 1725, Pocatello, Id. 83204

[21] Appl. No.: 467,144

[22] Filed: Feb. 16, 1983

[51] Int. Cl.[3] ..... A63C 9/00

[52] U.S. Cl. ..... 280/614; 280/633

[58] Field of Search ..... 280/614, 615, 633, 636; 441/70

[56] References Cited

U.S. PATENT DOCUMENTS

| | | | |
|---|---|---|---|
| 2,686,059 | 8/1954 | Whitaker | 280/614 |
| 3,388,918 | 6/1968 | Hollenback | 280/614 |
| 4,002,354 | 1/1977 | Ramer | 280/636 |
| 4,319,767 | 3/1982 | Emilson | 280/614 |
| 4,444,412 | 4/1984 | Callegari | 280/614 |

FOREIGN PATENT DOCUMENTS

| | | | |
|---|---|---|---|
| 2363562 | 7/1974 | Fed. Rep. of Germany | 280/633 |

*Primary Examiner*—Joseph F. Peters, Jr.
*Assistant Examiner*—Joseph G. McCarthy

[57] ABSTRACT

A snow ski is provided, including front and rear end portions, as well as front and rear binding mounting areas. A rear binding mount is attached to the rear mounting area and a boot heel binding is supported from the mount for selective guided shifting relative thereto between a forward active position and a rear inactive position. A front binding mount is attached to the front mounting area and downhill and cross-country boot toe bindings are supported from the front mount with the toe bindings positioned thereon in oppositely facing directions. The front bindings are supported as a unit from the front mount for selective position reversal thereon, whereby the front bindings may be selectively alternately positioned for binding the toe of a downhill or cross-country ski boot to the ski.

8 Claims, 10 Drawing Figures

62
14
66
78
2
3
3
2
64
61
40
16
12
60
10
4
54
10
4
10

45
44
50
46
44
40
46
48
45

14
68
45
76
70
78
72
74
70
80
68
62

40
16
44
45
54
56
46
52
50
48
44

10
14
32
70
74
72
70
32
32
32

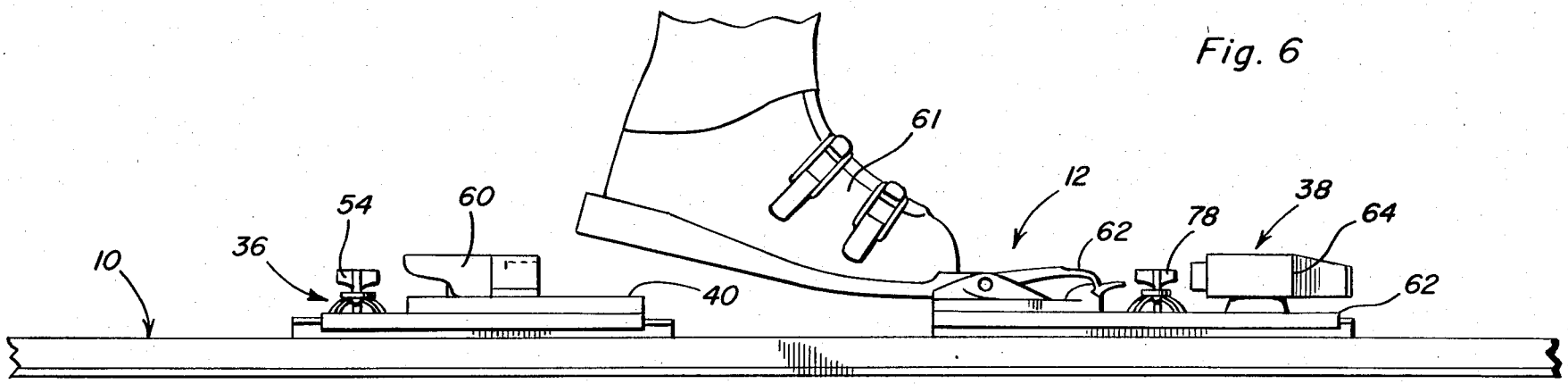
Fig. 6
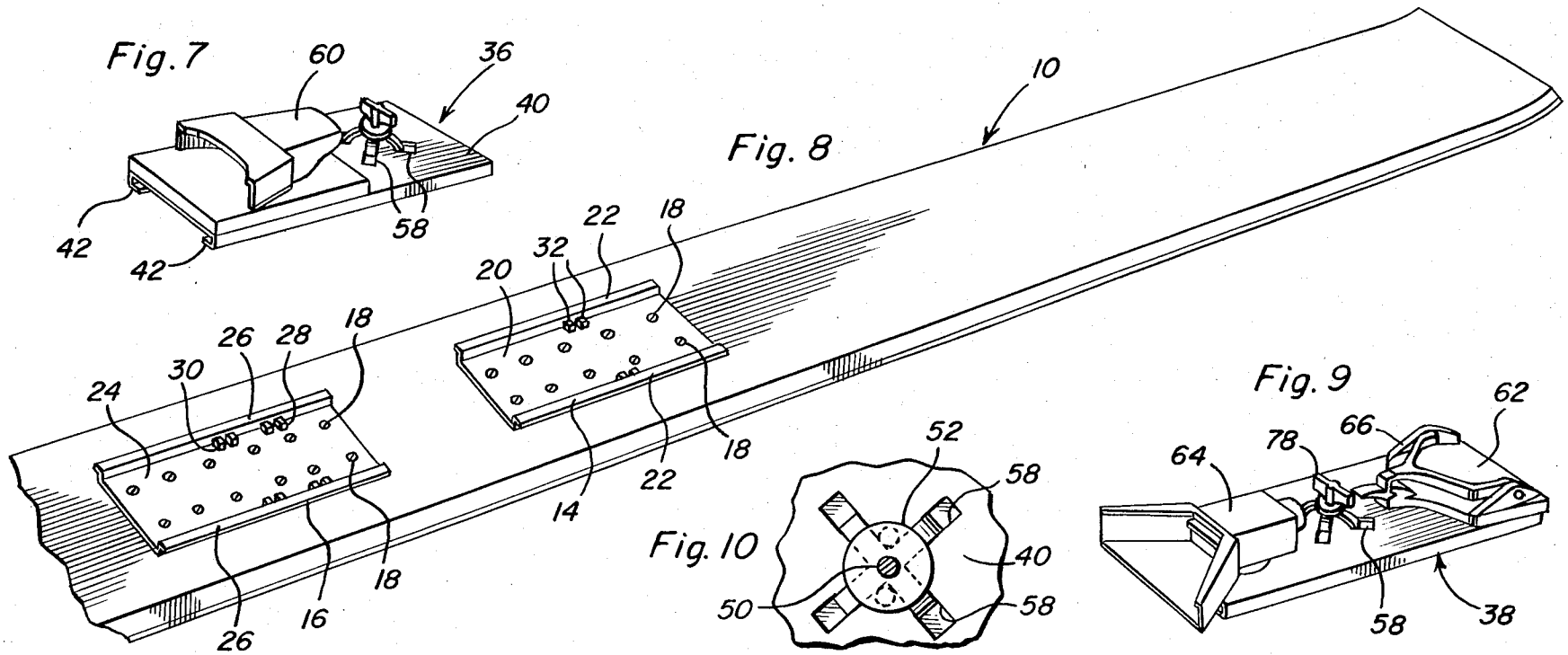
Fig. 8
Fig. 7
Fig. 9
Fig. 10

CONVERTIBLE SKI DEVICE

BACKGROUND OF THE INVENTION

Heretofore cross-country skiing and downhill skiing have been treated as sporting activities not usually practiced during a single ski outing. The primary reason for this is because downhill ski bindings serve to bind both the toe and the heel of a ski boot to a ski, while-cross-country ski bindings secure only the toe portion of a ski boot to a ski (since cross-country ski boots are equipped with a flexible sole in order that long leg strides accompanied by bending of the sole of a cross-country ski boot and elevation of the heel of a cross-country ski boot may be carried out).

Inasmuch as a greater percentage of skiers are now becoming interested in cross-country skiing as well as downhill skiing, a need exists for new forms of skiing equipment which will allow a skier to enjoy both downhill and cross-country skiing during the same outing. Although such dual purpose skiing equipment undoubtedly will include dual purpose skis which will be somewhat wider than cross-country skis and ski boots which may be selectively used in both the downhill and cross-country skiing modes, development of dual purpose skis and boots does not offer as great a problem as the development of dual purpose ski bindings.

Accordingly, a need exists for ski bindings which may be alternately used for downhill and cross-country skiing and with the conversion from cross-country and downhill skiing modes being readily accomplished without the use of tools and in a very short time.

Examples of various different ski bindings including some general structural and operational features of the instant invention are disclosed in U.S. Pat. Nos. 4,022,491, 4,088,342, 4,094,529, 4,103,930 and 4,128,157.

BRIEF DESCRIPTION OF THE INVENTION

The convertible ski device of the instant invention includes substantially conventional rear boot heel bindings of the downhill type, but the rear bindings are mounted on the associated ski for shifting between forward active positions and rearward inactive positions. In addition, the convertible ski device includes a front boot binding structure incorporating both a substantially conventional downhill toe binding and a substantially conventional cross-country toe binding mounted relative to each other in oppositely facing directions, from the associated ski, in a manner such that the positions of the downhill and cross-country toe binding structures may be reversed in position relative to each other on the associated ski. In this manner, when a skier is downhill skiing the rear binding is in the forwardly displaced active position and the front binding structure has the downhill binding disposed rearmost and opening rearwardly and the cross-country binding structure disposed forwardmost and opening forwardly. When it is desired to convert from downhill skiing to cross-country skiing, the rear binding is released from the associated ski boot and shifted to its rearmost inactive position and the front binding structure is reversed in position whereby the cross-country ski binding is disposed rearmost in a rearwardly opening position and the downhill ski binding is disposed forwardmost in a forwardly opening position.

The main object of this invention is to provide convertible ski bindings for use on snow skis and constructed in a manner whereby a skier equipped with appropriate skis and boots (or with both downhill *and* cross-country boots) may readily convert from downhill ski bindings to cross-country ski bindings and vice versa.

Another object of this invention is to provide convertible ski bindings which may be readily converted between downhill and cross-country modes of operation.

Another object of this invention is to provide convertible ski bindings, including structure thereof, which will enable conversion from cross-country to downhill operational modes and vice versa without the use of tools and with little effort and time being required on the part of the person desiring to effect such a conversion.

Another object of this invention to be specifically enumerated herein is to provide convertible ski bindings in accordance with the preceding objects and which will conform to conventional forms of manufacture, be of simple construction and easy to use so as to provide a device that will be economically feasible, long lasting and relatively trouble free in operation.

A final object of this invention is to provide ski bindings interchangeable among different pairs of skis, whereby one or several bindings may be alternately used with one or several different pairs of skis.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 6 is a fragmentary side elevational view similar to FIG. 1 but illustrating the ski bindings in the downhill skiing positions;

FIG. 7 is a perspective view of the rear ski binding;

FIG. 8 is a fragmentary perspective view illustrating the front and rear binding mounts operably secured to the longitudinal midportion of an associated ski;

FIG. 9 is a fragmentary perspective view of the front ski binding; and

FIG. 10 is an enlarged fragmentary horizontal sectional view taken substantially upon the plane indicated by the section line 10—10 of FIG. 1.

DETAILED DESCRIPTION OF THE INVENTION

Figure 1:
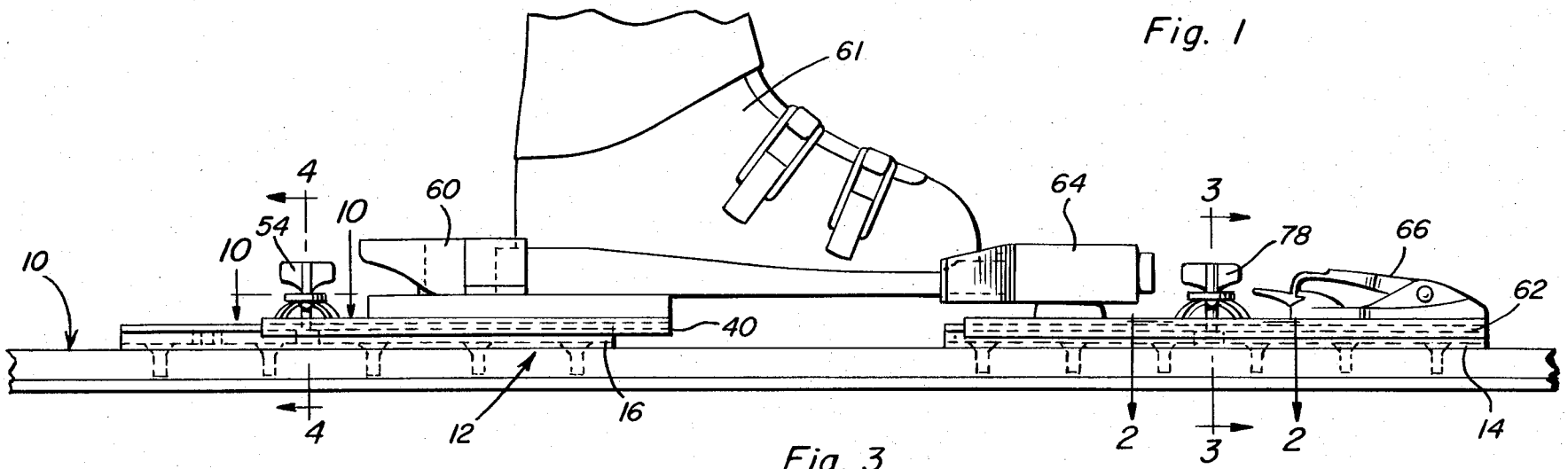
FIG. 1 is a fragmentary perspective view of a typical snow ski and with the convertible ski bindings of the instant invention operatively associated therewith and positioned for carrying out downhill skiing.
Figure 5:
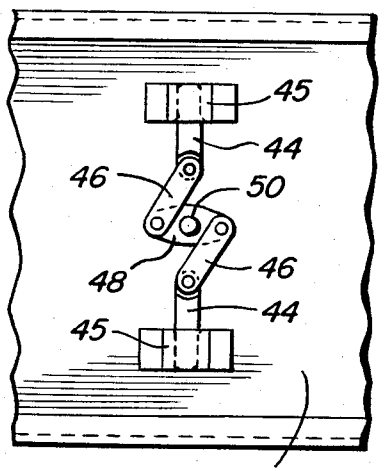
FIG. 5 is a fragmentary bottom plan view of one of the ski binding support plates of the convertible bindings illustrating latching pins thereof in the retracted positions.
Figure 3:
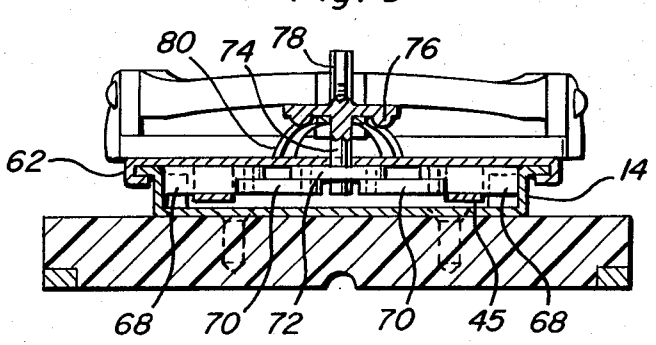
FIG. 3 is an enlarged transverse vertical sectional view taken substantially upon the plane indicated by the section line 3—3 of FIG. 1.
Figure 4:
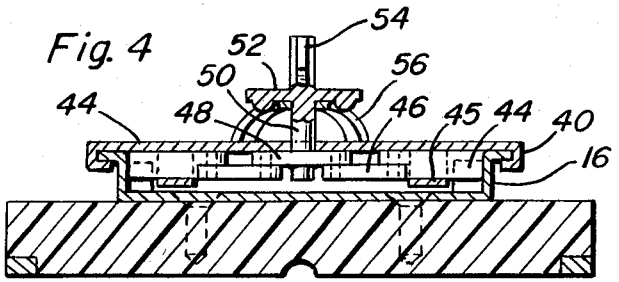
FIG. 4 is an enlarged transverse vertical sectional view taken substantially upon the plane indicated by the section line 4—4 of FIG. 1.
Figure 2:
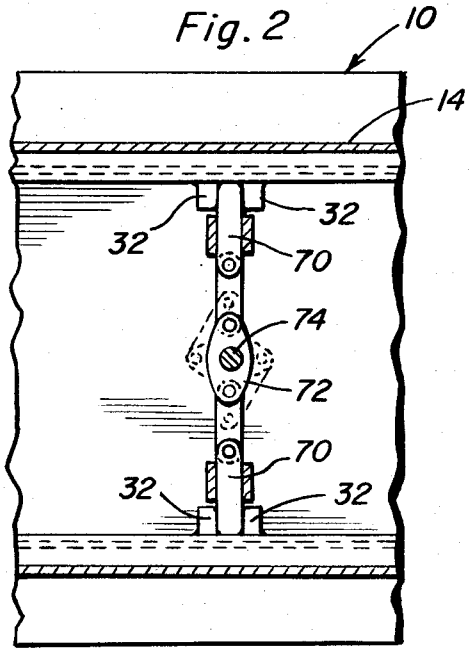
FIG. 2 is an enlarged fragmentary horizontal sectional view taken substantially upon the plane indicated by the section line 2—2 of FIG. 1.

Referring now more specifically to the drawings, the numeral 10 generally designates a ski of conventional design and which may more closely resemble a downhill ski than a cross-country ski. The ski 10 is equipped with the convertible device constructed in accordance with the present invention and referred to in general by the reference numeral 12. The convertible device 12 includes front and rear mounts 14 and 16 which are secured to front and rear portions of the ski 10 in stationary position thereon and in any convenient manner such as by fasteners 18. The mount 14 defines an upwardly opening channel 20 and elevated longitudinal and horizontally disposed opposite side flanges 22 while the mount 16 defines an upwardly opening channel 24 and opposite side outwardly projecting longitudinal flanges 26. The mount 16 includes two longitudinally spaced pairs of opposite side positioning lugs 28 and 30 while the mount 14 includes only one pair of opposite side positioning lugs 32. However, each pair of positioning lugs 28, 30 and 32 defines a pocket therebetween for receiving a positioning pin to be hereinafter more fully set forth.

The device 12 includes a rear binding assembly referred to in general by the reference numeral 36 and a front binding assembly referred to in general by the reference numeral 38. The binding assembly 36 includes a downwardly opening channel-shaped mounting plate 40 defining opposing inwardly opening opposite side channels 42 in which the flanges 26 are slidably receivable and a pair of transversely retractable and extendible pins 44 are guidingly supported by sleeves 45 supported from the underside of the mounting plate 40 and are connected by operating links 46 to operator 48 mounted on the lower end of an operator shaft 50 journalled through the mounting plate 40 and having a cam disc 52 as well as a thumb engageable tab 54 carried by its upper end portion. The shaft 50 extends upwardly through an apertured center portion of a cruciform spring 56 having downwardly bowed legs seated in recesses 58 provided therefor in the mounting plate 40 and the underside of the cam disc 52 is notched to receive the arms of the cruciform spring 56. Accordingly, 90° of angular displacement of the shaft 50 is effective to alternately retract and extend the pins 44, the latter being selectively receivable in the longitudinally spaced pairs of pockets defined between the positioning lugs 28 and 30. The mounting plate also supports a substantially conventional rear downhill heel binding 60. Accordingly, in the downhill mode of operation, the rear binding assembly 36 is in its forwardmost position with the pins 44 thereof received between the front pairs of positioning lugs 28 and with the downhill binding 60 opening forwardly and operatively engaged with the heel of a ski boot 61, see FIG. 1.

The front binding assembly 38 includes a mounting plate 62 similar to the mounting plate 40 and which supports not only a substantially conventional downhill toe binding 64 but also a substantially conventional cross-country toe binding 66. The toe bindings 64 and 66 open in opposite directions and the mounting plate 62 includes retractable pins 68 corresponding to the pins 44, links 70 corresponding to the links 46, an operator 72 corresponding to the operator 48 and a shaft 74 corresponding to the shaft 50 and upon which a cam disc 76 and thumb engageable tab 78 corresponding to the disc 52 and tab 54 are mounted. In addition, a cruciform spring 80 is provided on the mounting plate 62 corresponding to the spring 56. Accordingly, the pins 68 may be retracted and the mounting plate 62 may be slid longitudinally from the mount 14, reversed in positon and then again slidably engaged with the mount 14 and secured in position thereon by the pins 68 being received in the pockets defined between the positioning lugs 32. In this manner, either the binding 64 or the binding 66 may be positioned for engagement with the toe of the boot 62.

With attention invited to FIG. 6, when the binding 60 is secured in its rearwardly displaced position rearward of the boot 61, the binding 62 may be positioned rearmost on the mount 14 and engaged with the toe of the boot 61. This will enable cross-country skiing, the boot 61 being provided with a flexible sole portion enabling the rear of the boot 61 to swing upwardly from the ski 10. On the other hand, when downhill skiing is to be carried out, the mounting plate 62 may again be reversed in position so as to position the binding 64 rearmost and the mounting plate 40 may be shifted to its forwardmost position. This, of course, will enable the ski bindings 60 and 64 to be engaged with the heel and toe portions of the boot 61.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. In combination with a ski including front and rear end portions as well as front and rear boot binding mounting areas, a rear boot heel binding mount supported on said ski in said rear mounting area, a front boot toe binding mount supported on said ski in said front mounting area, rear ski binding mounting structure supported from said rear mount, a rear downhill boot binding supported from said rear ski binding mounting structure, means mounting said rear ski binding mounting structure from said rear mount for shifting thereon between a forward active position and a rear inactive position; front ski binding mounting structure mounted on said front mount, downhill and cross-country ski boot toe bindings supported from said front ski binding mounting structure in horizontally spaced apart positions thereon and with said downhill and cross-country toe bindings opening in opposite directions, said front ski binding mounting structure and said front binding mount including coacting structure releasably supporting said front ski binding mounting structure from said front binding mount for reverse positioning thereon.

2. The ski of claim 1 wherein said rear ski binding mounting structure includes a plate portion thereof adapted to underlie the heel of an associated ski boot when said rear ski binding mounting structure is in the front and rear positions thereof relative to the rear binding mount.

3. The ski of claim 1 wherein said front ski binding mounting structure includes a plate portion for underlying the toe of a ski boot when said front ski binding mounting structure is in its reversed positions relative to said front mount.

4. The ski of claim 1 wherein said front and rear mounts comprise channel members mounted in fixed position on said ski and said front and rear ski binding mounting structures comprise channel members longitudinally slidably engaged with said mount channel members.

5. The ski of claim 4 wherein each of said ski binding mounting structure channel members includes extendible and retractable latch portions and each of said front and rear mount channel members include keeper portions thereof with which the latch portions of said ski binding mounting structure channel members are releasably engageable.

6. The ski of claim 5 wherein each of said ski binding mounting structure channel members includes an oscillatable actuator operatively connected to the corresponding latch portions for extending and retracting the latter and detent means for releasably retaining the corresponding actuator in selected oscillated position thereof.

7. The ski of claim 6 wherein said rear ski binding mounting structure includes a plate portion thereof adapted to underlie the heel of an associated ski boot when said rear ski binding mounting structure is in the front and rear positions thereof relative to the rear binding mount.

8. The ski of claim 7 wherein said front ski binding mounting structure includes a plate portion for underlying the toe of a ski boot when said front ski binding mounting structure is in its reversed positions relative to said front mount.

* * * * *